US007600853B2

(12) United States Patent
Bensing et al.

(10) Patent No.: US 7,600,853 B2
(45) Date of Patent: Oct. 13, 2009

(54) LIQUID APPLIED SEAL FOR INKJET ORIFICES

(75) Inventors: Paige Anne Reardon Bensing, Lexington, KY (US); Karina Anne Krawczyk, Richmond, KY (US); Dell T. Rosa, Winchester, KY (US); Paul Timothy Spivey, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 227 days.

(21) Appl. No.: 11/281,091

(22) Filed: Nov. 17, 2005

(65) Prior Publication Data

US 2007/0109354 A1 May 17, 2007

(51) Int. Cl.
*B41J 2/165* (2006.01)

(52) U.S. Cl. ..... 347/28

(58) Field of Classification Search ..... 347/28, 347/29, 86, 87; 277/304; 285/10, 95
See application file for complete search history.

(56) References Cited

U.S. PATENT DOCUMENTS 4,231,046 A * 10/1980 Aiba ..... 347/44
5,075,365 A * 12/1991 Wallbillich ..... 524/261
5,400,060 A * 3/1995 Carlotta ..... 347/29
5,414,454 A * 5/1995 Reid ..... 347/29
5,850,238 A * 12/1998 Karita et al. ..... 347/29
5,917,514 A * 6/1999 Higuma et al. ..... 347/29
6,102,518 A * 8/2000 Taylor ..... 347/29
6,328,411 B1 * 12/2001 Taylor et al. ..... 347/29
6,634,732 B2 10/2003 Farr et al.

OTHER PUBLICATIONS

U.S. Appl. No. 11/095,955, Commonly owned.

* cited by examiner

*Primary Examiner*—Anh T. N. Vo
(74) *Attorney, Agent, or Firm*—Iusjuris

(57) ABSTRACT

A liquid is applied by a bounded-region applicator such as a needle applicator over nozzle holes and over at least a continuous region close to the nozzle holes. The liquid is then cured to a solid before significant flow of the liquid into the nozzle holes. The liquid is chosen to cure to a solid which is sufficiently compliant that it deforms and leaves the nozzle holes under moderate pressure from a human hand or finger without breaking. Depending upon the material in which the nozzles are formed and the size of the nozzle holes, the liquid may be uniquely designed to incorporate resilient moieties or segments to satisfy these factors.

4 Claims, 1 Drawing Sheet

LIQUID APPLIED SEAL FOR INKJET ORIFICES

TECHNICAL FIELD

This invention relates to inkjet printing and particularly to an effective seal over the orifices of inkjet printing cartridges.

BACKGROUND OF THE INVENTION

Inkjet cartridges are typically sealed with adhesive tape over the ink orifices to prevent ink evaporation, ink leakage, and contamination from getting into the nozzle holes. The adhesive of the adhesive tape tends to swell and soften when in contact with ink. The swollen softer adhesive can and does flow into the nozzle holes of the ink cartridge and occludes them, thereby preventing ejection of ink from the print head. This represents a challenge to engineer an adequate solution for both sealing the nozzle holes and not occluding them. All pressure sensitive adhesive based adhesive systems are reasonably expected to suffer from this same defect.

Most manufacturers have addressed this problem primarily through two approaches. First is to use a thermoplastic adhesive that has adherent properties when hot, and plastic properties when cool. The thermoplastic is heated just long enough to adhere the film to the nozzle plate and seal the nozzle holes; the thermoplastic promptly cools, freezing the material in place. In this form thermoplastic adhesives are significantly less susceptible to swelling, softening and flowing upon contact with ink. The second method involves a mechanical seal. A mechanical seal is usually composed of an elastomeric component that can be physically squeezed against the nozzle plate surface to seal the nozzle holes. Several variations of these are known in the art.

One known variation is to apply a tape having an uncured layer on the surface facing the nozzles. The uncured layer then is cured in a pattern which surrounds each nozzle. Curing may be by ultraviolet light or electron beam.

Other known options are to use a separate cap of some kind instead of a tape or the like directly over the orifices. Such options are prone to ink leakage because of poor sealing, with consequent ink migration over the printhead. This is unacceptable to the customer.

U.S. Pat. No. 6,634,732 B2 to Farr et al. is generally illustrative of the sealing of inkjet orifices of a cartridge a with a tape member. This invention is directed to the sealing of orifices of such cartridges.

With ongoing progress in inkjet printing, the nozzle holes are smaller. Smaller holes are more subject to being clogged. Direct application of tape on the nozzles entails some entry of tape material into the nozzle orifices, such as by initial pressure or by creep over time because of heat or chemical action of the ink. In the small orifices especially, the entered material is prone to breaking off and clogging the orifice.

Conventional pressure sensitive adhesive now used to seal nozzle holes is mobile and has a melting point significantly less than 400 degrees C. The mobility of pressure sensitive adhesive is necessary for the adhesive to closely conform to the surface to which it is applied and thereby adhere to it. Heat may be applied along with pressure when nozzles are sealed with pressure sensitive adhesive. But temperatures are limited as ink near the nozzles can expand and be expelled by high heat. Ink on the nozzle plate tends to destroy the sealing action of pressure sensitive adhesive.

Of course, any such seal must be removed for use of the ink cartridge. This invention recognizes that the system must have characteristics which permit the seal to be removed under moderate pressure by a human hand or finger.

DISCLOSURE OF THE INVENTION

This invention avoids the excessive creep by applying a liquid with a bounded-region applicator over the nozzle holes and over at least a continuous region close to the nozzle holes and then curing that liquid to a solid before significant flow of the liquid into the nozzle holes. The liquid is chosen to cure to a solid which is sufficiently compliant that it deforms and leaves the nozzle holes under moderate pressure from a human hand or finger without breaking. Depending upon the material in which the nozzles are formed and the size of the nozzle holes, the liquid must be carefully chosen. The liquid may be uniquely designed to incorporate resilient moieties or segments depending on these factors.

It is to be understood that both the foregoing general description and the following detailed description of the present embodiments of the invention are exemplary and explanatory, and are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and, together with the description, serve to explain the principles and operations of the invention.

DESCRIPTION OF PREFERRED EMBODIMENTS

Figure 2:
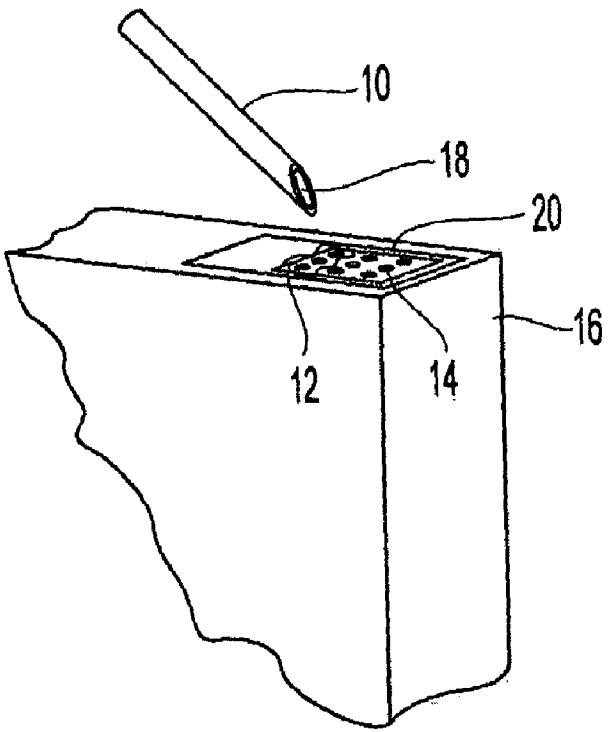
FIG. 2 is a front perspective view of an applicator applying a liquid to orifices of an inkjet ink container.
Figure 1:
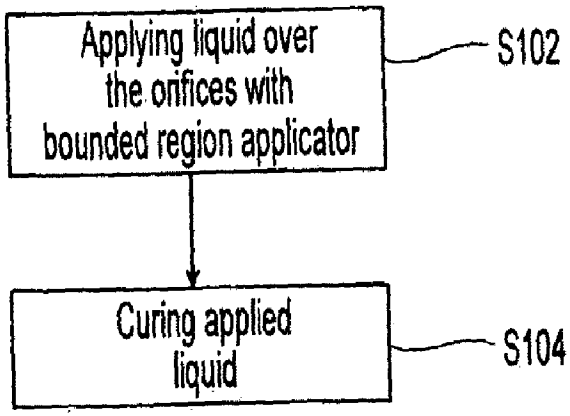
FIG. 1 is a block diagram illustrating one method of sealing orifices according to one embodiment of the present invention.

As illustrated in FIGS. 1 & 2, a bounded-region applicator 10 applies liquid 12 from a conduit or mask 14 over single, generally small region of an ink jet ink container 16. A mask, for example, would be a pattern of one or more openings analogous such as the mask used for stenciling. To cover a larger region, the conduit is moved or other conduits or other openings in a mask are employed.

In a development or prototype setting, which is the current state of this invention, a needle applicator is used as the bounded-region applicator 10. A needle applicator 10 has an elongated length and a comparatively small width roughly in the form of a standard sewing needle. The applicator has an internal hole forming a conduit 18 ending at one end of the elongated length by which a small stream of liquid 12 can be accurately applied through the hole 18 while moving the applicator.

To cover a wide area with a needle applicator 10, such as to cover adjoining columns of orifices 20, the end of the needle 10 is shaped into an oblong opening 16 from which the liquid 12 is applied. The oblong opening 18 has a wide dimension which covers the adjoining columns 18. Application is done while the needle 10 is moved down the columns while the wide dimension of the needle covers the columns, as indicated in step S102.

An advantage of a bounded-region applicator 10 is that the force of application of the liquid can be controlled at each point of the application. This contrasts with alternatives such a simply pouring the liquid and allowing it to spread. Similarly, spraying the liquid does not permit close control of the force of application of the liquid.

In a mass production setting the applicator 10 might well be a fixture with a large number of application conduits side-by-side. The fixture might or might not be moved, depending on the number and location of the application conduits. Similarly, a stencil sheet might be used, with a roller moving over the sheet to press the liquid through openings of the sheet.

An ultra violet curing adhesive 12 is preferred for this invention, as illustrated in FIG. 2 at step S104. However, this invention has not been defined for a specific orifice plate or other material. Different materials have different affinities with a give orifice plate. Although requiring careful design and presumably considerable trial and error, a curable material will be defined for each orifice plate or other orifice structure which is cures to a sufficiently compliant material so as to deform and leave the orifice holes and release from the surface in which the orifices are form under moderate pressure from a human hand or finger.

While this invention envisions simply peeling away the cured sealing material by hand or finger contact with the cured sealing material, additional elements to facilitate removal of the sealing material are also envisioned.

What is claimed is:

1. A method of sealing the orifices of an inkjet ink container comprising:

applying a liquid by a bounded-region applicator having an internal conduit with an oblong opening, the oblong opening allowing the liquid to be applied in a controlled manner over said orifices and at least in a contiguous regions around each of said orifices to seal said orifices from leaking ink during normal storage and handling; and curing said liquid to its cured state, said cured state be sufficiently compliant to permit said cured liquid to be removed from said orifices and said contiguous regions under moderate pressure from a human hand or finger.

2. The method of claim 1 in which said curing is before said liquid has flowed significantly into said nozzle holes.

3. The method as in claim 2 in which said bounded-region applicator comprises a needle with said internal conduit through which said liquid is applied.

4. The method of claim 1 in which said bounded-region applicator comprises a needle with said internal conduit through which said liquid is applied.

* * * * *

UNITED STATES PATENT AND TRADEMARK OFFICE

CERTIFICATE OF CORRECTION

PATENT NO. : 7,600,853 B2
APPLICATION NO. : 11/281091
DATED : October 13, 2009
INVENTOR(S) : Bensing et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 557 days.

Signed and Sealed this

Fifth Day of October, 2010

David J. Kappos

David J. Kappos
*Director of the United States Patent and Trademark Office*